US005088407A

United States Patent [19]

Helm et al.

[11] Patent Number: 5,088,407

[45] Date of Patent: Feb. 18, 1992

[54] ROTARY PRINTER FOR AN ENVELOPE MACHINE

[75] Inventors: Herbert W. Helm; William R. Hornung, both of Hollidaysburg; Ilya D. Khrakovsky, Duncansville; Fredrick L. Steinbeiser, Altoona, all of Pa.

[73] Assignee: F. L. Smithe Machine Company, Inc., Duncansville, Pa.

[21] Appl. No.: 514,086

[22] Filed: Apr. 25, 1990

[51] Int. Cl.[5] ..... B41F 31/00

[52] U.S. Cl. ..... 101/350; 101/363; 101/367

[58] Field of Search ..... 101/350, 363, 367, 216, 101/217, 148, 157, 154, 169

[56] References Cited

U.S. PATENT DOCUMENTS

| | | | |
|---|---|---|---|
| 2,988,989 | 6/1961 | Crawford | 101/154 |
| 4,009,657 | 3/1977 | Bonanno et al. | 101/157 |
| 4,186,661 | 2/1980 | Vieau | 101/350 |
| 4,488,485 | 12/1984 | Bolza-Schunemann | 101/350 |
| 4,597,329 | 7/1986 | Lembens | 101/363 |
| 4,602,564 | 7/1986 | Sakamoto et al. | 101/367 |
| 4,796,549 | 1/1989 | Okamura | 101/350 |
| 4,813,354 | 3/1989 | Thistle et al. | 101/350 |
| 4,879,949 | 11/1989 | Vennike | 101/157 |
| 4,899,654 | 2/1990 | Hoshi et al. | 101/157 |

*Primary Examiner*—Edgar S. Burr
*Assistant Examiner*—Ren Yan
*Attorney, Agent, or Firm*—Stanley J. Price, Jr.

[57] ABSTRACT

An envelope making machine includes a printer for printing material on the envelope blanks as they are being formed into envelopes in the machine. The printer has printing modules which include an impression cylinder, a plate or type cylinder, an anilox roll and a fountain roll. The fountain roll is positioned adjacent to and rotates in a direction opposite to the anilox roll and upon rotation transfers a film of ink to the surface of the anilox roll. A distributor or doctor blade is positioned below the anilox roll and has a blade edge portion that is approximately in juxtaposition with a lower quadrant of the anilox roll and faces the direction of rotation of the anilox roll to control and distribute the film of ink on the surface of the anilox roll. An adjustment device is provided to adjust the thickness of the film of ink on the anilox roll. The adjustment device is operable to make adjustments in the ink film thickness while the machine is operating.

7 Claims, 1 Drawing Sheet

ROTARY PRINTER FOR AN ENVELOPE MACHINE

THE BACKGROUND OF THE INVENTION

1. Field of the Invention

This invention relates to a rotary printer for an envelope making machine and more particularly to a rotary printer that includes an ink distributor blade that controls the thickness of the ink film on the anilox roll of the printer module.

2. Description of the Prior Art

Blades for distributing the film of ink on a roll are old and well known as disclosed in U.S. Pat. No. 2,655,102.

Reverse-angle doctor-blades have also been used in the past in flexo printing systems. Publications dated July 1970 and January 1972 by Pamarco, Inc. of Roselle, N.J. disclose and discuss the differences between the reverse-angle doctor-blade and the conventional doctor blade disclosed in U.S. Pat. No. 2,655,102. The reverse-angle doctor-blade is positioned relative to the anilox roll in a "shaving position" with an angle less than 90° between the blade and the tangent of the roll.

Other publications have discussed the development and evaluation of the reverse-angle doctor-blade ink distribution systems for flexo presses and the problems encountered with the direction of travel of the web and other problems with the adjustment of the doctor-blade assembly.

Flexo printing stations on envelope machines have also been used with envelope machines to print a plurality of colors while making the envelope. The flexo printing stations, however, required accurate and time-consuming adjustment of the ink fountain roll and anilox roll to obtain proper ink distribution on the type or plate cylinder. The use of a distribution blade presented substantial problems especially in obtaining access to the blade for adjustment, cleaning and replacement.

The prior art has not solved the problem of providing a flexo printing module for an envelope machine that is accessible for maintenance and provides a desired thickness of the ink film on the plate or type cylinder and simple and accurate control of the thickness of the ink film on the roll while the flexo printer is operating.

SUMMARY OF THE INVENTION

This invention relates to a rotary printer for an envelope machine that includes an impression cylinder arranged to rotate in a first direction and a plate cylinder mounted parallel to and adjacent the impression cylinder. The plate cylinder is arranged to rotate in a second direction that is opposite to the direction of rotation of the impression cylinder. An anilox roll is mounted parallel to and adjacent the plate cylinder. The anilox roll is arranged to rotate in a first direction that is the same as the direction of rotation of the impression cylinder. A fountain roll is mounted parallel to and adjacent the plate cylinder. The fountain roll is arranged to rotate in the second direction which is the same as that of the plate cylinder. An ink fountain is mounted below the fountain roll and the anilox roll. The fountain roll is partially immersed in the ink in the ink fountain so upon rotation of the fountain roll a continuous film of ink adheres to the surface of the fountain roll. A distributor blade is mounted below the anilox roll and has an edge portion in juxtaposition with the lower quadrant of the anilox roll adjacent the fountain roll so that the distributor blade distributes and controls the thickness of the film of ink transferred from the fountain roll. An adjustment means is provided to adjust the position of the distributor blade relative to the surface of the anilox roll to thereby control the thickness of the film of ink on the anilox roll that is transferred to the plate cylinder. Another feature of this invention includes the adjustment means operable to retract the distributor blade into an inoperative position away from the anilox roll and in spaced relation with the film of ink on the anilox roll. A second adjustment means may also be provided where both the anilox roll and the fountain roll may be moved as a unit toward and away from the plate cylinder to thereby control the thickness of the film of ink transferred to the plate cylinder. The fountain roll may also be adjusted relative to the anilox roll.

The invention further includes a method of printing in an envelope machine that includes mounting an impression cylinder in a support frame and rotating the impression cylinder in a first direction. A plate cylinder is mounted parallel to and adjacent the impression cylinder and the plate cylinder is rotated in a second direction opposite to that of the impression cylinder. An anilox roll is positioned parallel to and adjacent the plate cylinder and rotates in the same direction as the impression cylinder. A fountain roll is positioned parallel to and adjacent the plate cylinder and the fountain roll rotates in the same direction as the plate cylinder. An ink fountain is positioned below the fountain roll and the anilox roll with the fountain roll partially immersed in ink in the ink fountain. The fountain roll is rotated in a manner to form a continuous film of ink on its surface. A distributor blade is mounted below the anilox roll with an edge portion of the blade in juxtaposition with the lower quadrant of the anilox roll adjacent the fountain roll. The distributor blade distributes a film of ink of a preselected thickness on the surface of the anilox roll. The distributor blade is adjusted relative to the anilox roll surface to control the thickness of the film of ink on the anilox roll.

DESCRIPTION OF THE PREFERRED EMBODIMENTS

Figure 1:
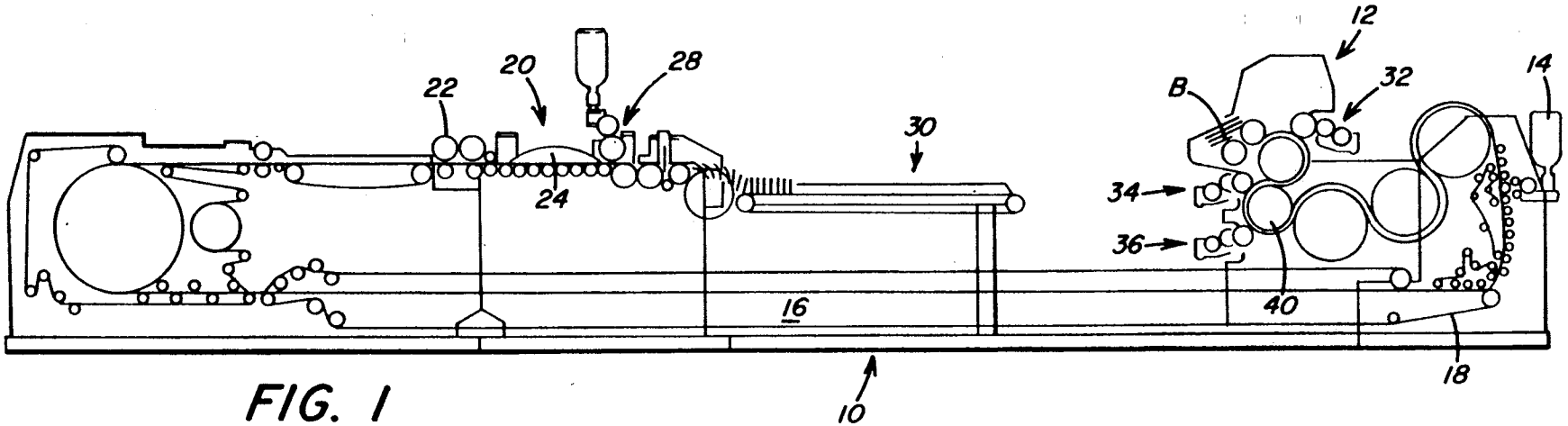
FIG. 1 is a schematic illustration of an envelope making machine that includes a printer section with a plurality of flexo printing modules arranged to print a plurality of colors on envelope blanks.

Referring to the drawings and particularly FIG. 1 there is illustrated diagramatically an envelope making machine generally designated by the numeral 10 which includes a printer unit generally designated by the numeral 12, a gummer or adhesive applicator 14 and a drying section 16. Envelope blanks are fed to the printer unit 12 and are schematically illustrated by the letter B and the envelope blanks B are conveyed by means of transfer rolls from the printer 12 to the gummer unit 14 where an adhesive is applied to preselected surfaces of the envelope blanks B. The envelope blanks B are conveyed by means of endless belts 18 through the dryer 16 and are then conveyed to the forming section 20 where suitable folding and conveying rolls 22 and plowshares 24 will form the envelope blank and apply an adhesive to the side flap at an adhesive applying section 28. The envelopes are then folded and are stacked on a stacking table 30.

The invention relates to the printing modules designated by the numerals 32, 34 and 36 which in this embodiment print three colors on the envelope blanks B which are fed from the stack 16. It should be understood that the printing modules 32, 34, and 36 are of substantially the same construction and FIG. 2 illustrates schematically the printing module 34.

It should be understood that suitable frame supports are provided in the printing section 12 of the envelope machine 10 to rotatably support the respective cylinders in journals for rotation and suitable drive gearing is connected to the respective rolls. The supports and drive of the various cylinders are conventional and do not form a part of the invention herein described.

Figure 2:
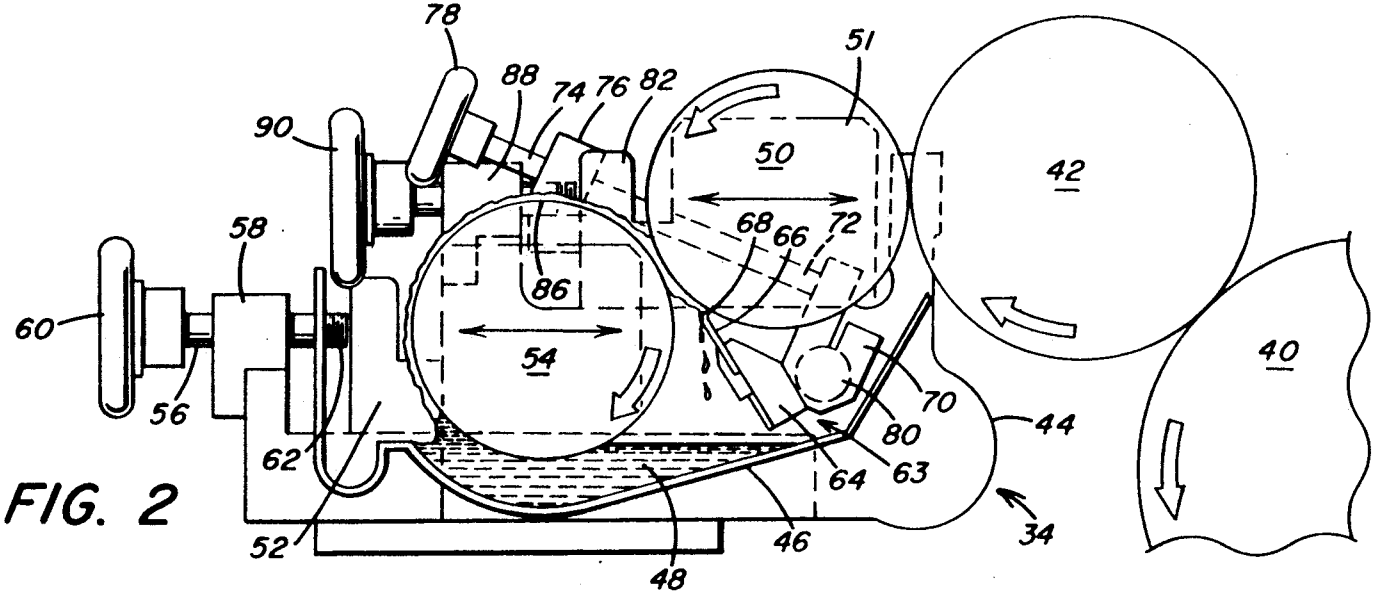
FIG. 2 is an enlarged schematic illustration of the flexo printing modules illustrated in FIG. 1.

Referring to FIG. 2, the printing module 34 is positioned adjacent an impression cylinder 40 which is rotatably journaled and driven in the printing unit 12. A type or plate cylinder 42 is positioned adjacent to the impression cylinder 40 and the envelope blank B is arranged to pass between the impression cylinder 40 and type cylinder 42 to transfer the inked image on the plate or type cylinder 42 onto the surface of the envelope blank B. The impression cylinder 40 as illustrated in FIG. 2 rotates in a counterclockwise direction and the plate cylinder 42 rotates in an opposite clockwise direction.

A housing 44 for the printing module 34 is illustrated by line and includes an ink fountain 46 which has a supply of ink 48 therein. Mounted in the housing 44 is an anilox roll 50 which is arranged to rotate in a counterclockwise direction similar to the direction of the impression cylinder 40. The anilox roll 50 is fixedly mounted on a frame 51 which in turn is mounted on a subframe 52 with the fountain roll 54. The fountain roll 54 is positioned adjacent to the anilox roll 50 and is arranged to rotate in a clockwise direction which is the same direction as the type or plate cylinder 42.

The cylinders 40, 42, 50 and 54 are positioned adjacent to each other as illustrated in FIG. 2. Suitable drive gearing is provided to rotate the four cylinders 40, 42, 50 and 54 in timed relation with each other.

The subframe 52 is mounted on the frame 51 and has an adjustment arm or shaft 56 where it is rotatably and nonaxially moveable in the upstanding journal 58 connected to the housing 44. The arm 56 has a handle 60 at one end and a threaded portion 62 at the other end. The portion 62 is threadedly secured in the subframe 52 so that upon rotation of handle 60 the subframe 52 supporting the fountain roll 54 is arranged to move toward and away from the anilox roll 50 to thereby adjust the spacing between the fountain roll 54 and the anilox roll 50.

A distributor blade or doctor blade assembly 63 is positioned on the frame 51 and has a transversely extending bar 64 with a blade 66 extending upwardly therefrom. The blade 66 has a front edge portion 68 which is arranged to "shave" or distribute the ink on the anilox roll 50. The blade edge portion 68 is positioned adjacent the lower lefthand quadrant of the anilox roll 50 so that the rotation of roll 50 is against the blade edge 68 to provide a "shaving" position for the doctor blade 66. The bar 64 is connected to a U-shaped member 70 which has an end portion 72 of an adjusting arm 74 rotatably secured therein. The adjusting arm 74 has a journal 76 for the adjusting arm 74. The outer end of the adjusting arm 74 has a handle 78 thereon. Thus by rotation of the doctor blade adjusting arm 74 the U-shaped housing 70 moves relative to the shaft 80 and moves the blade edge portion 68 toward and away from the surface of the anilox roll 50.

Frame 51 includes a frame portion 82 is movably positioned on the main frame 44 and has the fountain roll 54 and anilox roll 50 journaled therein. An adjustment arm 86 is rotatably journaled in a support 88 and has a threaded end portion (not shown) that extends into a threaded bore in the subframe 51. The opposite end of the arm 86 has a handle 90 thereon so that rotation of the handle 90 moves both the anilox roll 50 and the fountain roll 54 relative to the type or plate cylinder 42.

The printing module 34 operates in the following manner. The ink fountain 46 has a supply of ink 48 therein with a portion of the fountain roll 54 immersed in the ink. The fountain roll 54 is arranged to rotate in a clockwise direction. The fountain roll 54 is positioned adjacent to the anilox roll 50 and almost in juxtaposition therewith. The anilox roll 50 rotates in a counterclockwise direction and upon rotation of the fountain roll 54 a relatively thick film of ink adheres to the surface of the fountain roll 54 and an excess of ink accumulates at the nip between the fountain roll 54 and the anilox roll 50. The film of ink transferred to anilox roll 50 from the fountain roll 54 is illustrated by the heavy line in FIG. 2 and is an excessive amount of ink for transfer to the type or plate cylinder 42.

As the anilox roll 50 rotates the edge of the doctor blade 66 removes or "shaves" the excess ink from the surface of the anilox roll 50 and distributes the ink along the entire length of the anilox roll 50. The anilox roll 50 with the preselected thickness of ink film thereon upon further rotation beyond the doctor blade 66 contacts the surface of the plate or type cylinder 42 and deposits the ink on the type or plate cylinder 42. Rotation of the type or plate cylinder 42 impresses the inked raised type on the envelope blank as it is being conveyed by the impression cylinder 40 at the location where the impression cylinder 40 and plate cylinder 42 are in juxtaposition with each other.

To adjust the anilox roll 50 relative to the type or plate cylinder 42, the adjustment handle 90 is rotated to rotate the arm 86 and move the subframe 51 on which the anilox roll is mounted to move the subframe with both of the anilox roll 50 and the fountain roll 54 toward and away from the type or plate cylinder 42. To adjust the fountain roll 54 relative to the anilox roll 50 the adjustment handle 60 is rotated to move the fountain roll 54 toward and away from the anilox roll 50.

The distance of the distributor knife edge 68 from the surface of the anilox roll 50 to control the thickness of the ink film on the anilox roll 50 is accomplished by rotating the adjustment handle 78 and thus moving the blade 66 and the edge 68 relative to the surface of the anilox roll 50. Where it is desired to remove the doctor blade from operation within the module 34 the handle 78 is rotated to pivot the blade edge portion a sufficient distance away from the surface of the anilox roll 50.

From the above, it will be noted that it is now possible to make the above adjustments while the printing module 54 is in operation especially the fine adjustment of the doctor blade 66. It should be understood that other devices may be provided to adjust the respective rolls and to adjust the doctor blade 66 without departing from the herein described invention.

According to the provision of the Patent Statutes we have explained the principle, preferred construction and mode of operation of my invention and have illustrated and described what I now consider to represent its best embodiment. However, it should be understood that, within the scope of the appended claims, the invention may be practiced otherwise than as specifically illustrated and described.

We claim:

1. A rotary printer for an envelope machine comprising, a housing having a frame movable thereon, an impression cylinder rotatably supported adjacent to said housing and arranged to rotate in a first direction, a plate cylinder rotatably supported adjacent to said housing and mounted parallel to and adjacent to said impression cylinder, said plate cylinder arranged to rotate in a second direction, an anilox roll mounted on said frame parallel to and adjacent said plate cylinder, said anilox roll arranged to rotate in said first direction, said anilox roll having a lower quadrant, a subframe movably positioned on said frame, a fountain roll mounted on said subframe parallel to and adjacent said anilox cylinder, said fountain roll arranged to rotate in said second direction, an ink fountain mounted on said hosing below said fountain roll and said anilox roll, said fountain roll arranged to be partially immersed in said ink in said ink fountain so that upon rotation of said fountain roll a continuous film of ink adheres to the surface of said fountain roll, a distributor blade pivotally mounted on said frame below said anilox roll and above the surface of the ink in said ink fountain, said distributor blade being movable with said anilox roll upon movement of said frame relative to said fountain roll on said subframe, said distributor blade having an edge portion in approximate juxtaposition with the lower quadrant of said anilox roll adjacent said fountain roll so that rotation of said anilox roll is against said edge portion of said distributor blade to distribute and control the thickness of the film of ink transferred from said fountain roll to said anilox roll and deflect excess ink removed from the surface of said anilox roll back into said ink fountain, and first adjustment means for adjusting the position of said distributor blade relative to the surface of said anilox roll to thereby control the thickness of the film of ink on said anilox roll that is transferred to said plate cylinder.

2. A rotary printer for an envelope machine as set forth in claim 1 which includes, said adjustment means is operable to retract said distributor blade into an inoperative position away from sad anilox roll into spaced relation with said film of ink on said anilox roll and overlying sad ink fountain so that excess ink on said distributor blade is directed back into said ink fountain.

3. A rotary printer for an envelope machine as set forth in claim 1 which includes, second adjustment means for moving said frame relative to said housing to move both said anilox roll and said fountain roll as a unit toward and away from said plate cylinder to thereby control the thickness of the film of ink transferred to said plate cylinder.

4. A rotary printer for an envelope machine as set forth in claim 2 in which, said first adjustment means includes an arm member having opposite end portions, a threaded support member, means for rotatably mounting said support member on said frame, said arm member being mounted in said threaded support member intermediate said arm end portions, said distributor blade connected to said support member in a position above said ink fountain, and said arm member having one end portion connected to said support member and a handle connected to the other end portion of said arm member so that, upon rotation of said handle, said support member pivots relative to said frame to move said distributor blade toward and away from the surface of said anilox roll.

5. A rotary printer for an envelope machine as set forth in claim 3 which includes, third adjustment means for moving said subframe relative to said frame above said ink fountain, said third adjustment means including an arm member rotatably journaled in said housing and including an end portion secured to said subframe such that upon rotation of said arm member in said housing said subframe moves on said frame to move said fountain roll toward and away from said anilox roll to adjust the spacing between said fountain roll and said anilox roll, said second adjustment means including an arm member rotatably mounted in said housing, said second adjustment means arm member including a threaded end portion threadedly secured to said frame for said fountain roll and said anilox roll, said second adjustment means arranged upon rotation of said arm member thereof to move said frame on said housing to move both said fountain roll and said anilox roll relative to said plate cylinder, and said distributor blade being pivotal to a preselected position on said frame below and between said anilox roll and said fountain roll to facilitate unobstructed movement of said fountain roll relative to said anilox roll.

6. A method of printing in an envelope machine comprising, mounting an impression cylinder in a housing and rotating said impression cylinder in a first direction, mounting a plate cylinder parallel to and adjacent said impression cylinder in said housing and rotating said plate cylinder in a second direction, mounting an anilox roll on a frame parallel to and adjacent said plate cylinder and rotating said anilox roll in said first direction, mounting a fountain roll on a subframe parallel to and adjacent said anilox cylinder and rotating said fountain roll in said second direction, supporting said subframe for movement on said frame and supporting said frame for movement relative to said housing, positioning an ink fountain on said housing below said fountain roll and said anilox roll, said fountain roll partially immersed in ink in said ink fountain, rotating said fountain roll and forming a continuous film of ink on the surface of said fountain roll, mounting a distributor blade below said anilox roll and above said ink fountain with an edge portion of said blade in approximate juxtaposition with the lower quadrant of said anilox roll adjacent said fountain roll, distributing a film of ink of a preselected thickness on the surface of said anilox roll with said distributor blade, deflecting excess ink removed from the surface of said anilox roll back into said ink fountain, adjusting said distributor blade relative to said anilox roll surface to thereby control the thickness of the film of ink on said anilox roll, adjusting the position of said fountain roll relative to said anilox roll by movement of said subframe on said frame, and adjusting the position of said fountain roll and said anilox roll relative to said plate cylinder by movement of said frame relative to said housing.

7. A method of printing in an envelope machine as set forth in claim 6 which includes adjusting said distributor blade edge relative to the surface of said anilox roll while said rolls are rotating and envelope blanks are being printed as they pass between said plate cylinder and said impression cylinder.

* * * * *